US005251897A

United States Patent [19]

Fulton

[11] Patent Number: 5,251,897

[45] **Date of Patent: * Oct. 12, 1993**

[54] METHOD OF PLAYING A POKER-TYPE GAME

[75] Inventor: Stanley E. Fulton, Las Vegas, Nev.

[73] Assignee: D.D. Stud, Inc., Las Vegas, Nev.

[ * ] Notice: The portion of the term of this patent subsequent to Mar. 31, 2009 has been disclaimed.

[21] Appl. No.: 911,018

[22] Filed: Jul. 9, 1992

Related U.S. Application Data

[63] Continuation of Ser. No. 784,696, Oct. 30, 1991, Pat. No. 5,167,413, which is a continuation-in-part of Ser. No. 605,443, Oct. 30, 1990, abandoned.

[51] Int. Cl.[5] ..... A63F 1/00

[52] U.S. Cl. ..... 273/85 CP; 273/85 G; 273/274

[58] Field of Search ..... 273/85 CP, 85 G, 237, 273/274, 292

[56] References Cited

U.S. PATENT DOCUMENTS

| | | | |
|---|---|---|---|
| 3,735,982 | 5/1973 | Gerfin | 273/85 CP |
| 4,363,486 | 12/1982 | Chaudhry et al. | 273/143 B |
| 4,651,997 | 3/1987 | Wood | 273/274 |
| 4,659,087 | 4/1987 | Shen et al. | 273/274 |
| 4,700,948 | 10/1987 | Okada | 273/143 R |
| 4,743,022 | 5/1988 | Wood | 273/85 CP |
| 4,760,527 | 7/1988 | Sidley | 273/85 CP |
| 4,836,553 | 6/1989 | Suttle et al. | 273/292 |
| 4,926,327 | 5/1990 | Sidley | 273/138 A |
| 4,948,134 | 8/1990 | Suttle et al. | 273/85 CP |
| 4,955,619 | 9/1990 | Christman | 273/273 |
| 5,019,973 | 5/1991 | Wilcox et al. | 273/85 CP |
| 5,022,653 | 6/1991 | Suttle et al. | 273/85 CP |
| 5,042,818 | 8/1991 | Weingardt | 273/85 CP |
| 5,100,137 | 3/1992 | Fulton | 273/85 G |
| 5,167,413 | 12/1992 | Fulton | 273/85 CP |

FOREIGN PATENT DOCUMENTS

| | | |
|---|---|---|
| 8705015 | 12/1987 | Fed. Rep. of Germany . |
| 3801502 | 7/1989 | Fed. Rep. of Germany . |
| 2117546 | 10/1983 | United Kingdom . |

*Primary Examiner*—V. Millin
*Assistant Examiner*—Steven B. Wong
*Attorney, Agent, or Firm*—Daniel P. Burke

[57] ABSTRACT

A poker-type card game which provides a player with an opportunity to increase the amount wagered, and therefore to increase a winning payout, even after the player has received a definite indication that the player has won. Apparatus useful with the game method include a board game version and an electronic video game version which allow a player to increase his wager after reviewing a first display of a plurality of cards.

16 Claims, 4 Drawing Sheets

METHOD OF PLAYING A POKER-TYPE GAME

RELATED APPLICATIONS

This patent application is a continuation of U.S. patent application Ser. No. 07/784,696 filed on Oct. 30, 1991, now U.S. Pat. No. 5,167,413 which is a continuation-in-part of U.S. patent application Ser. No. 605,443 filed Oct. 30, 1990, now abandoned.

BACKGROUND OF THE INVENTION

The present invention relates to a poker-type card game and entertainment apparatus for playing the game.

Gambling is an exceedingly common form of entertainment to a great number of people. Players tend to like games that provide a chance of "winning big", are exciting to play, are simple to play, utilize a reasonable amount of thinking ability, and have a high payout ratio. For the casino, desirable games are fast so that the game can be played repeatedly in a very short period of time with each play only taking a matter of a few seconds.

Casinos have long utilized machines to be operated by the players obviating the need for dealers. An exceedingly common form of such machines have been referred to as "slot machines". Slot machines do not require the need of a dealer and permit the player to play at his/her pace at the particular machine.

At one time, slot machines utilized only a plurality of rotating tumblers with indicia, such as cherries, lemons, oranges and other fruit, being represented on the tumblers. When the same type of fruit is in alignment at a horizontal line, the slot machines paid off a winning amount.

Within recent years, the slot machine has been expanded to be utilized with other types of games. For example, machines have been utilized to play blackjack and poker. Such machines have been readily accepted and provide a way of playing blackjack and poker at wagering levels which are substantially less than what would be required at a table for such a game where a dealer is utilized.

SUMMARY OF THE INVENTION

The present invention comprises a poker-type card game and apparatus for playing the game.

The card game of the present invention may be played with one or more players. At the start of a hand, a player is allowed to make an initial wager. A plurality of playing cards are then displayed to the player. The object of the game for the player is to obtain a hand with at least one of a pre-selected plurality of winning card arrangements After receiving this initial display, the player is given the option of making an additional, limited wager thereby giving that player a chance of increasing his winning payout even though that player may have already received a definite indication of success. The player then receives additional cards to complete his hand. A comparison is made between the player's hand and the pre-selected plurality of winning card arrangements. If the player's hand has at least one of the winning card arrangements, the player is provided with a winning payout.

According to one embodiment of the present invention, the game of the present invention is played on a game board utilizing at least one deck of playing cards.

An alternative embodiment of the apparatus of the present invention comprises an electronic game having a video display screen which displays indications of playing cards, such as those in a conventional poker deck consisting of four different suits with each suit containing thirteen different cards. The video game of this embodiment of the present invention is activated by a player inserting a wager into the machine. After the initial wager has been received by the machine, the machine provides an initial video display of a plurality of cards but less than the total number of cards to be displayed during the game. Since a player's success in playing the game of the present invention is determined by whether the displayed cards comprise at least one of a pre-selected plurality of card arrangements, a player may know that he will receive a winning payout upon viewing the initial card display. The player is provided with a novel opportunity to take advantage of this knowledge since the machine is adapted to receive an additional, limited wager after making the initial display. Suitable circuitry within the apparatus calculates the total amount wagered which, according to this embodiment of the present invention, is the sum of the initial wage and the additional wager. After receiving the additional wager, or an indication that the player does not wish to place an additional wager, the video game of this embodiment displays the remainder of the cards. The machine then automatically compares the combination of displayed cards with the pre-selected plurality of winning card combinations. Electronic controls are also provided for calculating and providing a winning payout (based upon the total wager) to the player if the displayed card arrangement comprises at least one of the pre-selected winning card combinations. The present invention thus provides players with an opportunity to increase their winnings even after they have determined that they have a "winning hand".

Another embodiment of the present invention is programmed to provide instructions to the player when player action is required.

One embodiment of the present invention is an electronic, poker-type game comprising:

means for receiving an initial wager ($w_1$);

means for displaying (T-r) cards wherein

T=the total number of cards displayed and r=the number of cards not displayed during the initial display and wherein r is at least 1;

means for receiving an additional wager ($w_2$) thereby giving a player a chance to increase his winning payout after receiving an indication of success;

means for calculating the total wager (W);

means for displaying (r) additional cards;

means for comparing the combination of (T) cards with a pre-selected plurality of winning card combinations; and means for calculating and providing a winning payout based on the total wager (W) if the displayed combination of (T) cards comprises at least one of said pre-selected plurality of winning card combinations.

DETAILED DESCRIPTION

The games of the present invention provide a novel concept to poker-type games wherein a player has a chance to increase his wager even though he has already received an indication that he will definitely be provided with a winning payout. Various embodiments are disclosed for implementing the game of the present invention into an electronic gaming apparatus as well as a board game.

Figure 1:
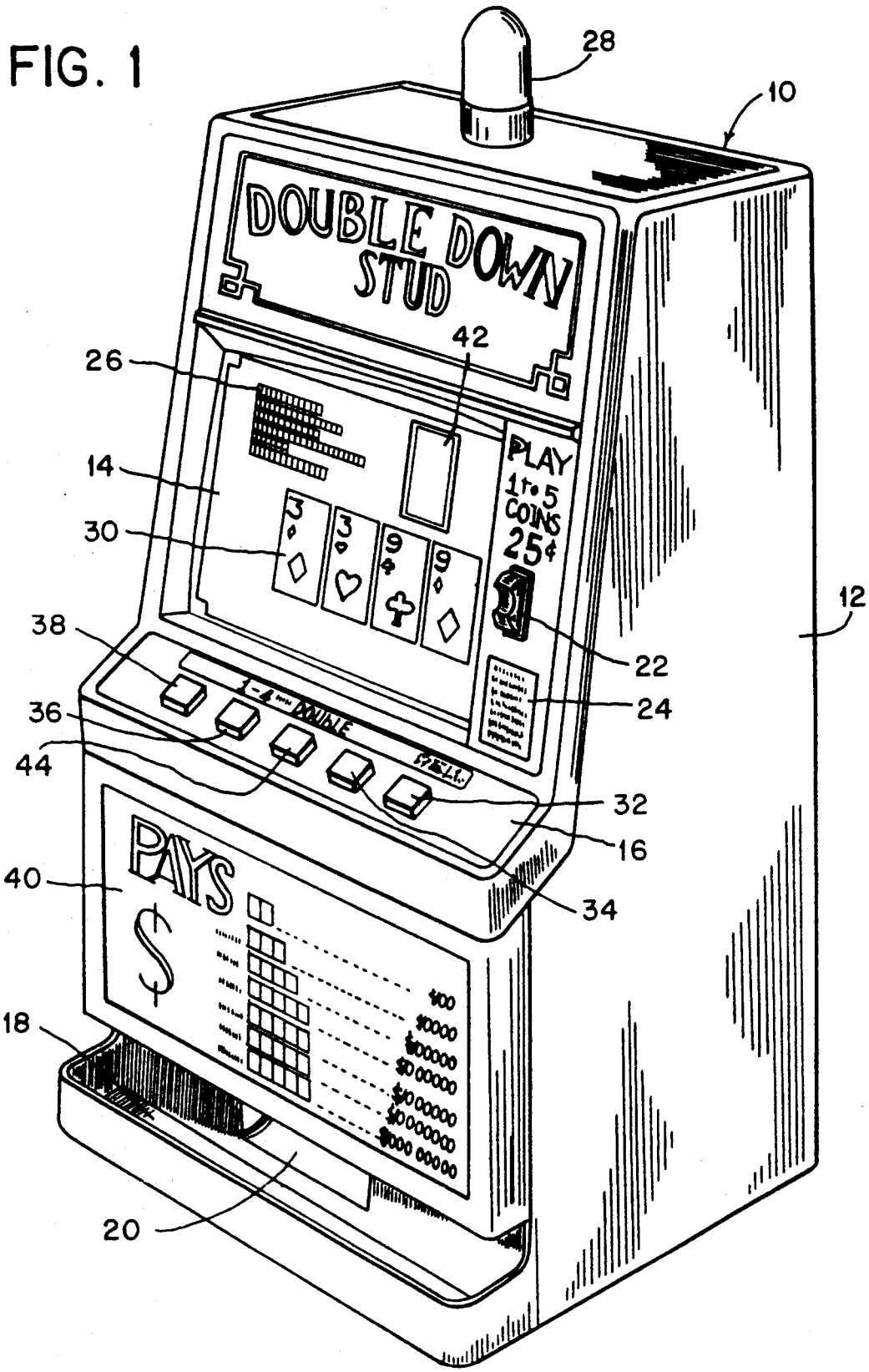
FIG. 1 depicts a typical configuration of a video game version of the present invention.

According to one embodiment of the present invention illustrated in FIG. 1, there is shown a machine 10 which includes a housing 12 having a front face panel which includes a video display screen 14, a button ledge 16 and a coin payout trough 18. A coin discharge chute 20 connects with the trough 18. The game is started when a player deposits coins within a coin deposit slot 22. Those skilled in the art will appreciate that some limit is usually placed on the initial wager. In the illustrated embodiment, an indication is provided on the face of the machine 10 that a player may place an initial wager of from 1 to 5 coins or chips. Also included on the front face panel of the housing 12 are game instructions 24 to instruct the player as to how to play the game and preferably written instructions 26 on the video screen 14 as to what action is required by the player at a particular time. The illustrated housing 12 also includes a flashable light 28 mounted on the top of the housing 12. The function of the flashable light 28 is to announce a jackpot or the equivalent thereof.

According to the embodiment of the present invention shown in FIG. 1, included within the housing 12 are appropriate electronics and software which are preprogrammed to effect the playing of the game of this invention. The particular electronic elements utilized and programming format could be readily assembled and performed by one skilled in the art in light of the description provided herein, therefore, further detailed explanation of the specific electronics and programming is not provided herein.

This illustrated embodiment is a poker-type game using five cards. Before play is commenced, the machine may be programmed to generate one or more messages on display screen 14. Play is commenced by the receipt of an initial wager ($w_1$) in coin slot 22. Suitable controls and detectors may also be provided for detecting coins in amounts other than the maximum wager and for calculating the total amount of the initial wager ($w_1$). After receiving the initial wager ($w_1$), video machine 10 is programmed to display a plurality of cards less than the total amount of cards to be displayed. Thus, if the total amount of cards to be displayed before the completion of the game is five cards, then the initial display may include four cards as illustrated in FIG. 1. For purposes of further illustration, if T = the total number of cards displayed before the completion of the game and r = the number of cards initially not displayed, i.e., withheld or shown face down, then the initial display can be represented by (T-r) cards. In accordance with this embodiment of the present invention, if the player inserts five coins within the coin slot 22, wherein five is the maximum number of coins this particular game 10 is designed to accommodate for any given single play, four cards 30 will be displayed. If the player wishes to play the game with less than five coins, once the player has inserted the desired number of coins, the player then must press button 32 which will cause the program in the machine 10 to electronically "shuffle the cards" and then deal the cards 30 by displaying such on the display screen 14.

The primary advantage the player has in conjunction with game 10 of this embodiment of the invention is that the player, after viewing the initial display of (T-r) cards 30, has the opportunity to increase his wager since the machine 10 is adapted to receive an additional wager ($w_2$). Thus, even though the player may already be assured that he will receive a winning payout based upon the initial display of (T-r) cards, the player is provided with the opportunity to increase his winning payout by simply increasing his wager at this time. Those skilled in the art will appreciate that the amount of the additional wager ($w_2$) must be limited. For example, the additional wager ($w_2$) may be limited to an amount equal to the initial wager ($w_1$), though additional wagers of other amounts are considered within the scope of the present invention. The player might select to increase the original bet, for example, if 1) the player already has a winning hand shown within cards 30, or 2) the player has a reasonably good chance to achieve a winning hand when receiving the additional card 42.

If the player does not wish to increase his wager after viewing the initial display of cards, the game will continue. Those skilled in the art will appreciate that the machine can be designed to allow the player to provide an indication of his intention not to increase his bet after receiving his initial display of cards, such as by depressing button 32. Alternatively, a suitable delay may be incorporated into the circuit to simply allow the player a set time period in which to increase his total wager with an additional wager ($w_2$) before play continues. The electronic game of this embodiment of the present invention is provided with suitable circuits and controls for calculating the total amount of the wager which in this embodiment, is the sum of the initial wager and the optional additional wager ($W = w_1 + w_2$).

Play continues by machine 10 providing a display of the remaining (r) cards. Machine 10 then automatically compares the combination of the total (T) number of cards displayed on video screen 14 with a pre-selected plurality of winning card arrangements.

There is preferably displayed on the front panel a payout schedule 40. A typical payout schedule for the game of this invention using five cards might be for the player to break even if the player receives a winning hand containing a pair between sixes and tens, to double the player's wager if a pair of jacks to aces is received, and to triple the player's wager if two pair is received. An appropriate increased payout schedule could be as follows: three of a kind—four for one, straight—six for one, flush—nine for one, full house—twelve for one, four of a kind—fifty for one, straight flush—two hundred for one, and a royal flush—two thousand for one. Thus, if the royal flush is received, and ten coins are wagered, twenty thousand coins would be won by the player.

Alternative methods of displaying the respective payouts of different winning combinations such as by providing this information on the video screen itself or at some location distant from the game may also be desired.

After comparing the displayed card combination with the pre-selected winning card arrangements, the game is either ended if there is no match between the displayed cards and at least one of the pre-selected winning card arrangements, or the player is provided with a winning payout based upon the payout schedule and his total wager (W).

From the above description, it will be appreciated that the use of the term "cards" herein is not intended to be limited to a physical playing card but also includes any representation of a card from a conventional poker-type deck. It is also within the scope of the present invention that the term "cards" include different indicia which may be considered in combination to match at least one of a pre-selected plurality of winning combinations resulting in different winning payouts to the player.

Figure 3:
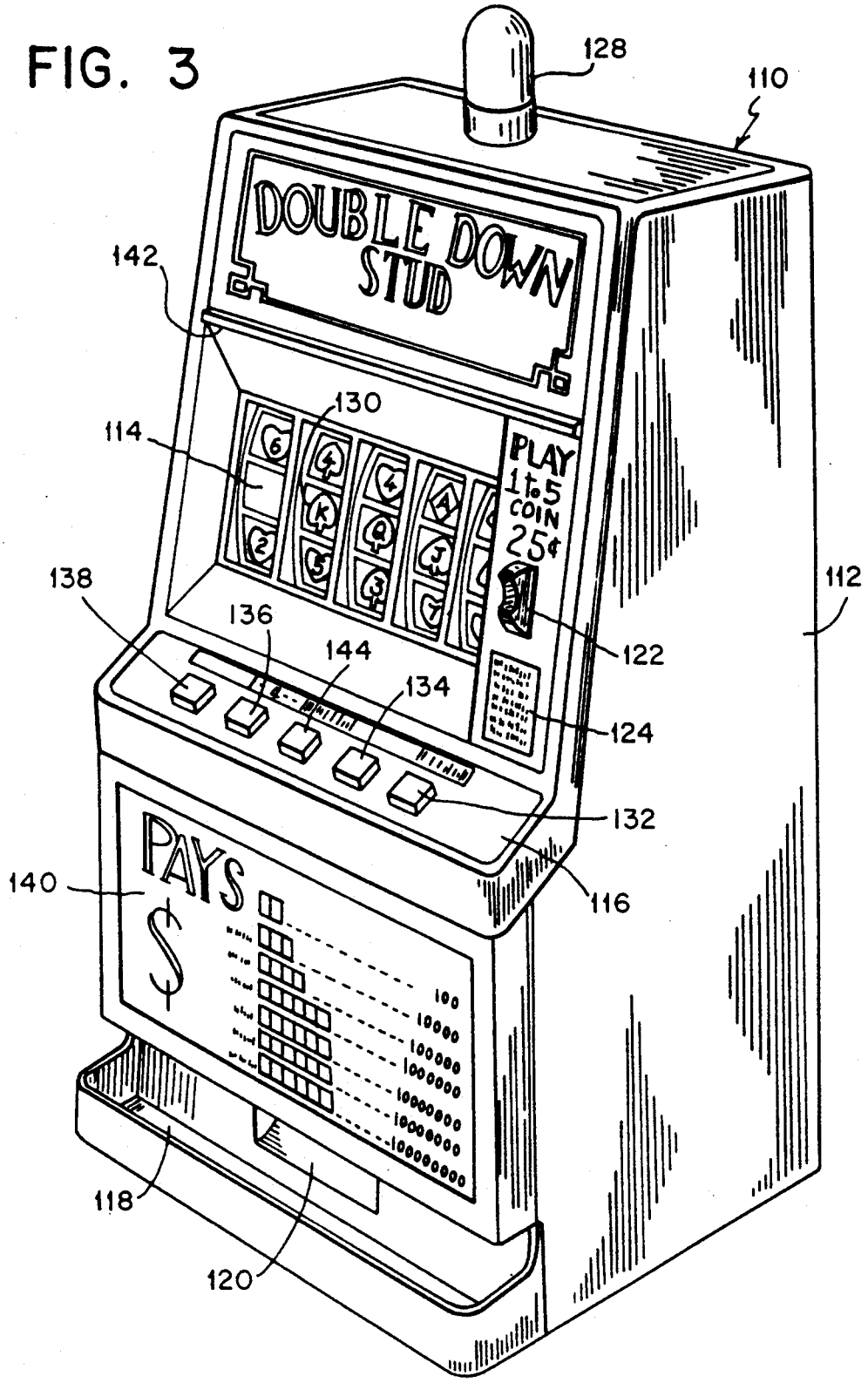
FIG. 3 illustrates an alternative embodiment of the present invention.

Furthermore, while a preferred embodiment of the present electronic, poker-type game of the present invention comprises a video display screen, alternative display devices such as a plurality of rotatable reels 114 as shown in FIG. 3 and which are well known in the art may be utilized. Though the illustrated embodiment of the present invention has been described as automatically providing a randomly selected display of a card, controls well known in the art may also be provided to stop a changing display, such as rapidly rotating reels, in order to give the player some sense of control over the card selection. The number of cards displayed at various stages of the game may also be varied without departing from the scope of the present invention.

Machine 10 can also accrue credits which means there is not necessarily a payout each and every time there is a win. If the player wishes to play against these credits, the player can push button 34 which will deduct the maximum number of coins, which is five in number of coins (credits), from the number of credits that has been accumulated. If the player wishes to bet against the credit(s) some number less than the maximum number of five, the player only needs to press button 36. Each time button 36 is pressed, a deduction of one credit will occur which is equivalent to one coin.

Once the player has selected the desired number of credits with which to play the particular game, the player then must press button 32, unless maximum coins have been played, which will cause the cards 30 to be displayed on the display screen 14.

In order to double the original bet, the player presses button 44. Once the button 44 is pressed, the amount equal to the original bet will automatically be deducted from the accumulated credit(s) if sufficient credit(s) are available. However, if there are not sufficient credit(s), the player must insert coins in coin slot 22 equal to the original bet in order to double the bet. By the player doubling the original bet, a winning player will receive double the winning payout.

If the player has accumulated a number of credits in playing of the machine 10 and desires to no longer play the machine 10 and wishes to collect the corresponding number of coins for the credits that have accumulated, the player only needs to push button 38 which will cause the corresponding number of coins to be discharged from coin discharge chute 20 into coin collection trough 18.

In all embodiments of the present invention, the player is given the opportunity to increase his or her bet even if that player has already received a definite indication that he or she has a winning hand.

Figure 2:
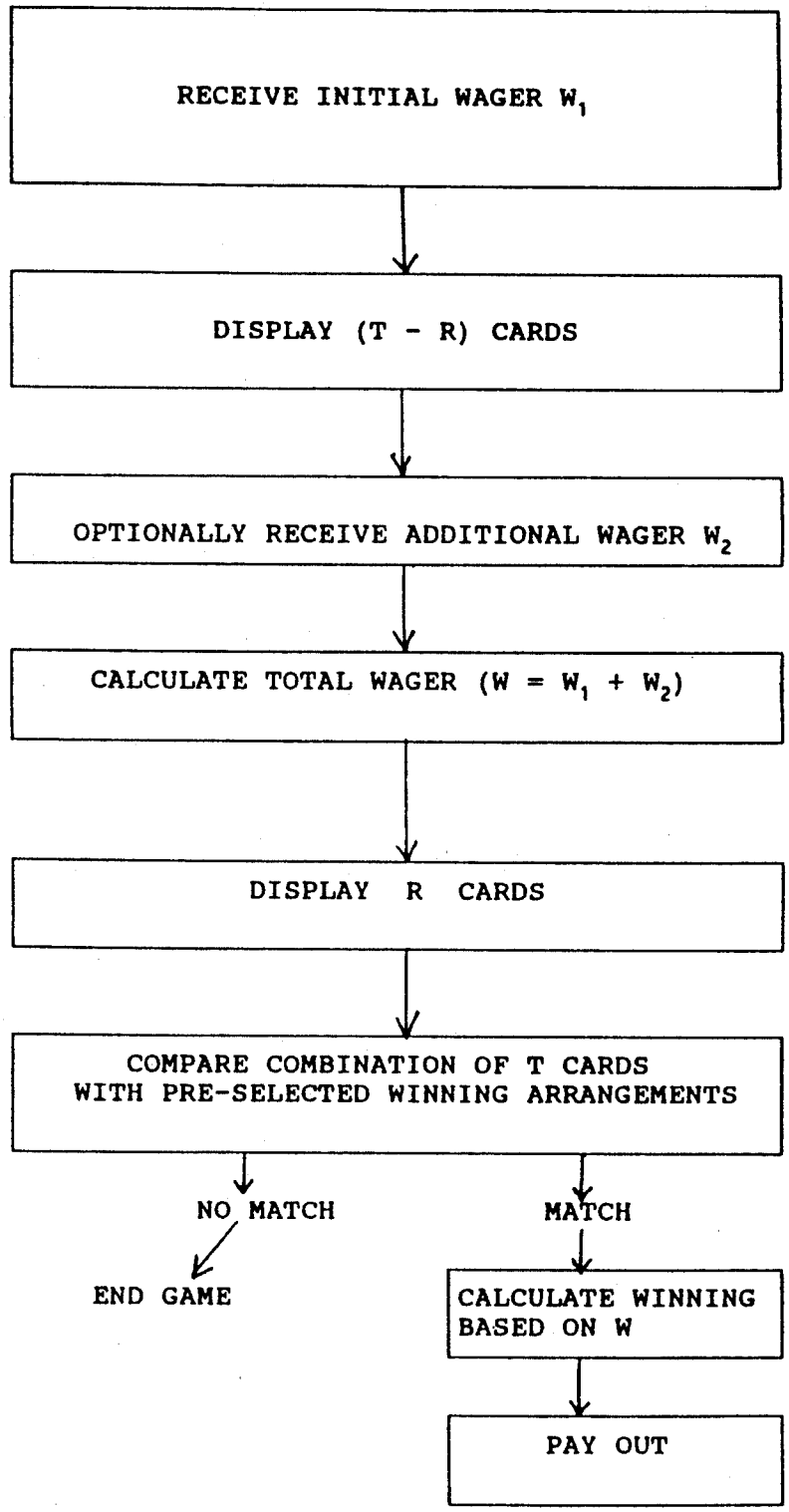
FIG. 2 is a flow chart illustrating the operational functions performed by one embodiment of the present invention.

FIG. 2 provides a flow chart of the most significant aspects of the electronic, poker-type game described above. As indicated, the game is designed to receive an initial wager ($w_1$), display a plurality of (T-r) cards which is less than the total (T) cards to be displayed, to optionally receive an additional wager ($w_2$), to calculate the total wager, to display the remaining (r) cards, to compare the combination of displayed (T) cards with a pre-selected plurality of winning card arrangements, and lastly to calculate and provide a winning payout based upon the total wager (W) if the displayed cards comprise at least one of the pre-selected winning card arrangements.

Figure 4:
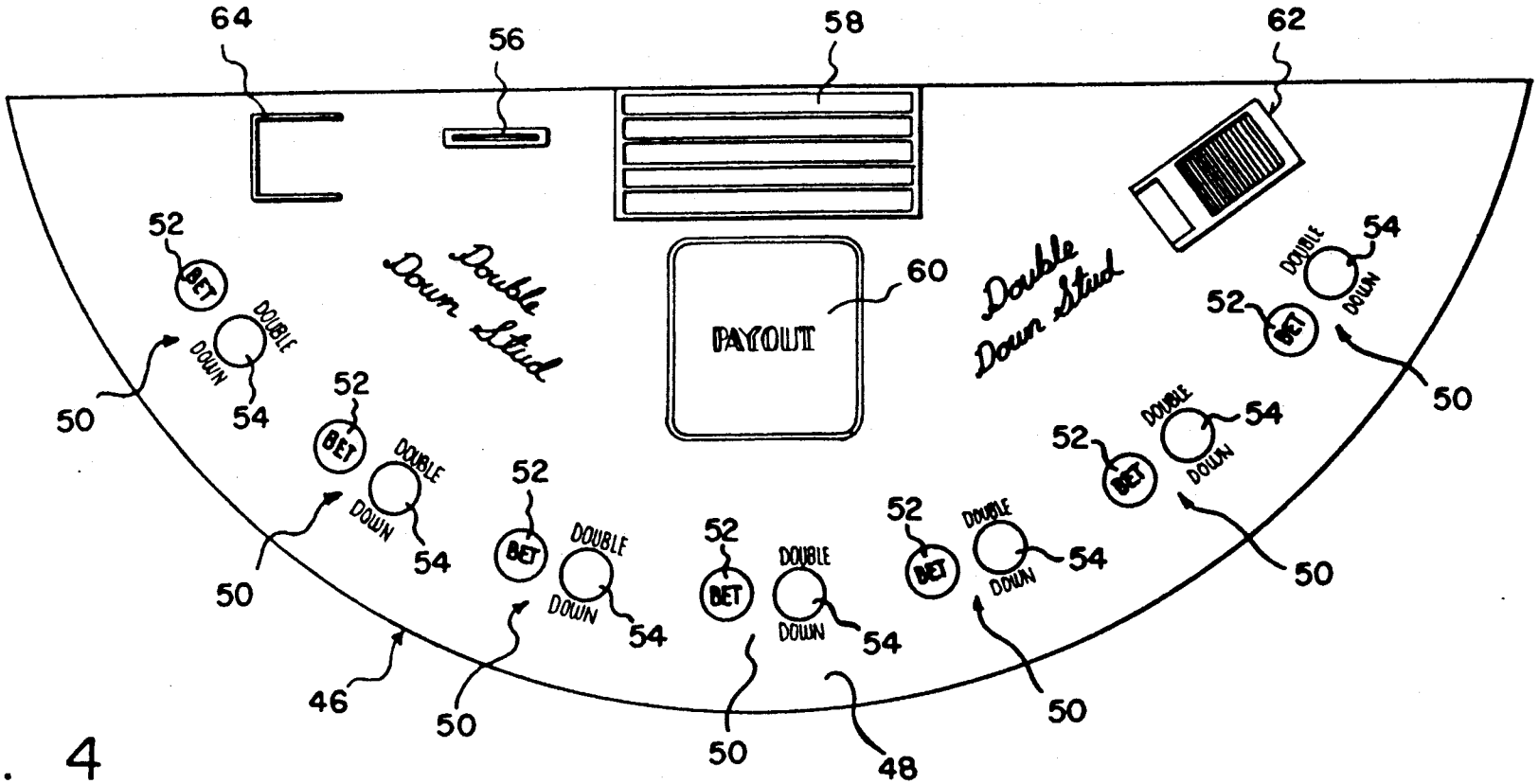
FIG. 4 illustrates a game board embodiment of the present invention.

Those skilled in the art will appreciate that the previously described apparatus illustrated in FIGS. 1 and 3 are suited for playing without the need for a dealer. The present invention may also be played in a more traditional form utilizing a game board such as the game board 46 shown in FIG. 4. As illustrated, the game board 46, which may be in the form of a table, includes a playing surface 48 divided into a plurality of player stations 50. According to the illustrated embodiment, each player station 50 includes bet placement areas 52 and 54. These bet placement areas may be provided with indications for directing the player to place their bets within these areas. Game board 46 is designed to receive a player's, initial wager in bet placement area 52 and to optionally receive an additional wager in area 54. As illustrated, bet placement area 54 may include an indication of the limit on the additional wager, such as double the amount of the initial wager.

Playing surface 48 may also be provided with conventional gaming table items such as a currency drop slot 56, a chip rack 58, a payout area 60, a dealing card shoe 62 and a card collector 64. Furthermore, a payout schedule may be provided for informing the players of winning card combinations during the play of the present invention. Alternative game boards may also be provided without departing from the scope of the present invention.

What is claimed is:

1. A method of playing a card game between a dealer and at least one player comprising the steps of:

providing a playing apparatus comprising a display surface for displaying a plurality of playing cards and means for receiving a plurality of wagers;

directing at least one player to place an initial wager;

providing at least one player with a plurality of (T-r) playing cards where

T=the total number of cards displayed and r=the number of cards not displayed during the initial display and wherein r is at least 1;

allowing at least one player to place an additional optional wager thereby giving a player a chance to increase his winning payout after receiving an indication of success;

displaying (r) additional cards;

comparing the combination of (T) cards with a pre-selected plurality of winning card combinations; and calculating and providing a winning payout based on the total wager if the displayed combination of (T) cards comprises at least one of said pre-selected plurality of winning card combinations.

2. A method of playing a card game according to claim 1 further comprising the step of displaying indicia of success comprising a plurality of winning card combination.

3. A method of playing a card game according to claim 1 wherein said step of providing a display surface comprises providing a game board having a playing surface on which a plurality of playing cards are displayed.

4. A method of playing a card game according to claim 3 wherein said step of providing a game board comprises providing a game board comprising at least one wagering area for receiving a plurality of wagers.

5. A method of playing a card game according to claim 4 wherein said step of providing a game board comprises providing a game board comprising at least two wagering areas for each player.

6. A method of playing a card game according to claim 1 wherein said dealer and said playing apparatus are embodied in an electronic gaming device.

7. A method of playing a card game according to claim 6 wherein said step of providing a display surface comprises providing a video screen.

8. A method of playing a card game according to claim 6 wherein said step of providing a display surface comprises providing a plurality of rotatable reels.

9. A method of playing a card game according to claim 1 wherein $T=5$.

10. A method of playing a card game according to claim 9 wherein $r=1$.

11. A method of playing a card game according to claim 1 wherein said step of providing means for receiving plurality of wagers comprises providing at least one designated wager area on a game board.

12. A method of playing a card game according to claim 1 wherein said display surface and said receiving means are provided on a single gaming table.

13. A method of playing a card game according to claim 1 wherein said step of providing a playing apparatus comprising a display surface for displaying plurality of playing cards and means for receiving a plurality of wagers comprises:

providing a game board comprising display areas for displaying a plurality of playing cards and wager areas for receiving a plurality of wagers.

14. A method of playing a card game comprising the steps of:

providing a display surface;

providing at least one player with the option of placing a wager;

displaying a plurality of playing cards to at least one player;

providing at least one player with an opportunity to increase said player's total wager thereby providing a player with a chance to increase said player's total wager and thereby increase said player's winning payout after receiving a definite indication of success;

displaying at least one additional card;

comparing a plurality of said displayed cards with a pre-selected plurality of winning card combinations; and providing a winning payout if a plurality of said displayed cards matches at least one of said pre-selected winning card combinations.

15. A method of playing a card game according to claim 14 wherein said display surface comprises a portion of a game board.

16. A method of playing a card game according to claim 14 wherein said display surface comprises a video screen.

* * * * *